US008514212B2

(12) United States Patent
Chou

(10) Patent No.: US 8,514,212 B2
(45) Date of Patent: Aug. 20, 2013

(54) DRIVE CIRCUIT OF DISPLAY AND METHOD FOR CALIBRATING BRIGHTNESS OF DISPLAY

(75) Inventor: Yen-Ynn Chou, Jhonghe (TW)

(73) Assignee: Princeton Technology Corporation, Taipei County (TW)

( * ) Notice: Subject to any disclaimer, the term of this patent is extended or adjusted under 35 U.S.C. 154(b) by 894 days.

(21) Appl. No.: 12/615,133

(22) Filed: Nov. 9, 2009

(65) Prior Publication Data

US 2010/0164930 A1 Jul. 1, 2010

(30) Foreign Application Priority Data

Dec. 31, 2008 (TW) ..... 97151771 A

(51) Int. Cl.
*G09G 5/00* (2006.01)

(52) U.S. Cl.
USPC ..... 345/211; 345/212; 345/213; 345/214

(58) Field of Classification Search
USPC ..... 345/211–214
See application file for complete search history.

(56) References Cited

U.S. PATENT DOCUMENTS 6,448,948 B1 * 9/2002 Friedman ..... 345/74.1
2010/0039458 A1 * 2/2010 Nathan et al. ..... 345/698

* cited by examiner

*Primary Examiner* — William Boddie
*Assistant Examiner* — Leonid Shapiro
(74) *Attorney, Agent, or Firm* — Muncy, Geissler, Olds & Lowe, PLLC

(57) ABSTRACT

A drive circuit of a displayer for driving at least a pixel, including: an output stage coupled to the pixel and controlled by a pixel signal to switch an output voltage on the pixel; a calibration device coupled between the output stage and the pixel and including an input end controlled by a bias voltage further calibrating the brightness of the pixel; a stabilizing device coupled between the input end of the calibration device and the pixel signal for stabilizing the voltage on the input end of the calibration device to be at the level of the bias voltage after a variation; and a accelerating device coupled between the stabilizing device and a voltage source for generating the bias voltage and accelerating the speed stabilizing the voltage on the input end of the calibration device to be at the level of the bias voltage.

13 Claims, 6 Drawing Sheets

DRIVE CIRCUIT OF DISPLAY AND METHOD FOR CALIBRATING BRIGHTNESS OF DISPLAY

CROSS REFERENCE TO RELATED APPLICATIONS

This Non-provisional application claims priority under 35 U.S.C. §119(a) on Patent Application No(s). 097151771, filed in Taiwan, Republic of China on Dec. 31, 2008, the entire contents of which are hereby incorporated by reference.

BACKGROUND OF THE INVENTION

1. Field of the Invention

The present invention relates to displays, and in particular relates to drive circuits of the displays.

2. Description of the Related Art

FIG. 1 is a schematic diagram illustrating the driver circuit in the prior art. The drive circuit 100 comprises a pixel 102 and an output stage 104 used for driving the pixel 102. The output stage 104 of the driver circuit 100 further comprises a p-type MOSFET (PMOS) 112 and an n-type MOSFET (NMOS) 114, and each of the transistors 112 and 114 comprises a gate coupled to a pixel signal $S_p$ and controlled by the pixel signal $S_p$ to switch an output voltage $V_{out}$ on the pixel 102 between a high level $V_H$ and a low level $V_{GND}$.

The output voltage $V_{out}$ on the pixel 102 influences the brightness of the pixel, while the characteristic of the display influences that as well. Taking the carbon nanotube display (CNDP) for example, owing to its particular characteristic, the brightness of the CNDP will increase when it ages. For this case, it is necessary for the drive circuit 100 to comprise a calibration device 130 to calibrate the brightness of the display. For example, in the calibration device 130 in FIG. 1, the transmission gate composed of a PMOS $T_1$ and a NMOS $T_2$ could be controlled by a bias voltage $V_{bias}$ to calibrate the equivalent resistance of the calibration device 130 to further adjust the brightness of the pixel 102.

However, the coupling effect of the transistor $T_1$ (there is a coupling capacitor between the gate and the source/drain) makes the output voltage $V_{out}$ influencing the bias voltage $V_{bias}$. The output voltage $V_{out}$ on the pixel 102 alternates between the two voltage levels according to the pixel signal $S_P$. When the output voltage $V_{out}$ switches from the low voltage $V_{GND}$ to the high voltage $V_H$, the output voltage makes the bias voltage $V_{bias}$ raise rapidly and causes a surge $P_1$ therein; when the output voltage $V_{out}$ switches from the high voltage $V_H$ to the low voltage $V_{GND}$, the output voltage makes the bias voltage $V_{bias}$ descend rapidly and causes a surge $P_2$ therein. In addition, the drive circuit 100 of the display is a high voltage device, and the high voltage $V_H$ on the pixel 102, for example, could be as high as 110 volt, therefore, the surge $P_1$ and $P_2$ are not negligible. Once the bias voltage $V_{bias}$ changes, the equivalent resistance of the calibration device 130 changes accordingly and thus results in luminance flickers on the display.

To settle the problems mentioned above, the drive circuit 100 could further comprise a stabilizing device 140. The stabilizing device 140 is coupled to the input end A of the calibration device 130 for suppressing surges in the bias voltage $V_{bias}$ which occurs due to the switch of the output voltage $V_{out}$. For example, the stabilizing device 140 could comprise the voltage pulling down device 141, the voltage pulling up device 142 and the bias transmission device 143. FIG. 3A shows the timing diagram of the output voltage $V_{out}$, and FIG. 3B shows the timing diagram of the voltage provided by the stabilizing device 140 corresponding to the output voltage $V_{out}$. In FIG. 3B, the section 1, section 2 and section 3 are respectively caused by the voltage pulling down device 141, the bias transmission device 143 and the voltage pulling up device 142. In the section 1, the voltage is pulled down to the grounded voltage $V_{GND}$ to neutralize the surge $P_1$ in FIG. 2; in section 2, the voltage is stabilized to be at the ideal level, the level of the bias voltage $V_{bias}$; and in section 3, the voltage is pulled up to the high voltage $V_H$ to neutralize the surge $P_2$ in FIG. 2.

However, from FIG. 3B, the stabilizing device 140 does not perform very well in section 2 essentially because of the low charging speed of the bias transmission device 143. Therefore, if there is an apparatus for improving this performance, the brightness of the display will become more stable.

BRIEF SUMMARY OF INVENTION

The present invention provides a drive circuit of a displayer for driving at least a pixel. The drive circuit comprises an output stage, a calibration device, a stabilizing device and an accelerating device. The output stage is coupled to the pixel and controlled by a pixel signal to switch an output voltage on the pixel between a high voltage and a low voltage; the calibration device is coupled between the output stage and the pixel and comprising an input end controlled by a bias voltage to calibrate the equivalent resistance of the calibration device for further calibrating the brightness of the pixel; the stabilizing device is coupled between the input end of the calibration device and the pixel signal for stabilizing the voltage on the input end of the calibration device to be at the level of the bias voltage after a variation; and the accelerating device is coupled between the stabilizing device and a voltage source for generating the bias voltage and accelerating the speed stabilizing the voltage on the input end of the calibration device to be at the level of the bias voltage.

The present invention also provides a method for calibrating the brightness of a display. The method comprises disposing an output stage, wherein the output stage is coupled to at least a pixel of the display, and the output stage is controlled by a pixel signal to switch an output voltage on the pixel between a high voltage and a low voltage; disposing a calibration device between the output stage and the pixel; imposing a bias voltage on the calibration device to calibrate a equivalent resistance of the calibration device for further calibrating the brightness of the pixel; stabilizing the voltage on the input end of the calibration device to be at the level of the bias voltage after a variation; and accelerating the speed stabilizing the voltage on the input end of the calibration device to be at the level of the bias voltage.

A detailed description is given in the following embodiments with reference to the accompanying drawings.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 4:
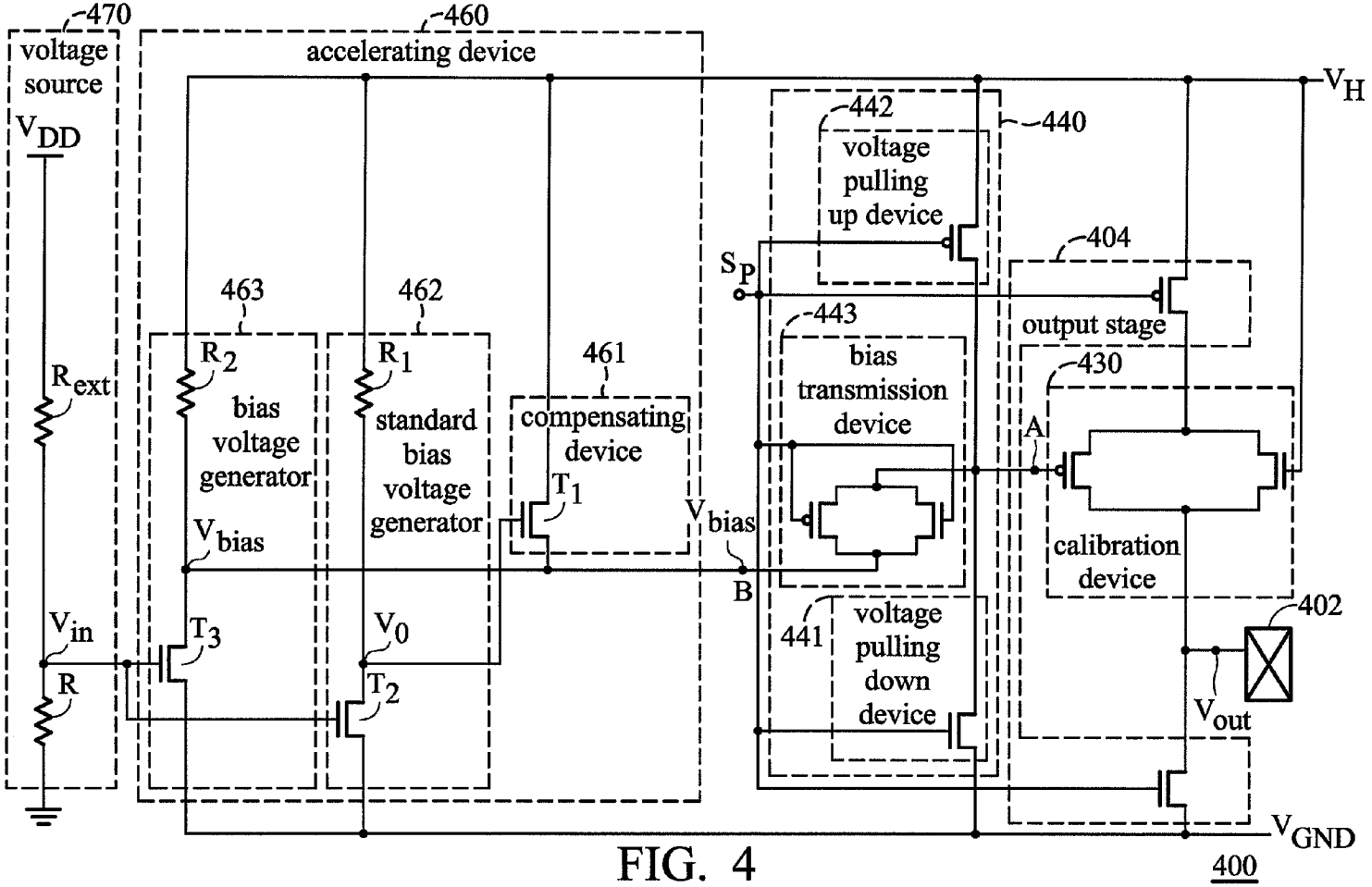
FIG. 4 is a schematic diagram of the drive circuit of a display according to the present invention.

FIG. 4 is a schematic diagram of the drive circuit of a display according to the present invention. The drive circuit 400 is used for driving at least a pixel 402. The drive circuit 400 further comprises an output stage 404, a calibration device 430 and a stabilizing device 440. The output stage 404 is coupled to the pixel 402 and controlled by a pixel signal $S_P$ to switch the output voltage $V_{out}$ on the pixel 402 between a high voltage $V_H$ and a low voltage $V_{GND}$. The calibration device 430 is coupled between the output stage 404 and the pixel 402 and comprises an input end A for being controlled by a bias voltage $V_{bias}$ to calibrate the equivalent resistance of the calibration device 430 for pixel brightness calibration. The stabilizing device 440 is coupled between the input end A of the calibration device 430 and the pixel signal $S_P$ for stabilizing the voltage on the input end of the calibration device to be at the level of the bias voltage $V_{bias}$ after a variation. In a preferred embodiment, the stabilizing device 440 further comprises a bias transmission device 443 for receiving and transmitting the bias voltage $V_{bias}$, a voltage pulling up device 442 and a voltage pulling down device 441 for pulling up and down the voltage on the input end A. To settle the problems mentioned in the description of the related art, the drive circuit 400 further comprises an accelerating device 460. The accelerating device 460 is coupled between the stabilizing device 440 and a voltage source 470 and used for generating the bias voltage $V_{bias}$ and accelerating the speed stabilizing the voltage on the input end of the calibration device to be at the level of the bias voltage $V_{bias}$. The voltage source 470 is used for providing an input voltage $V_{bias}$ and could be implemented in many embodiments, for example, the voltage source 470 comprises an internal resistor $R_{in}$ and an external $R_{ext}$ which are connected in series and coupled to a voltage $V_{DD}$, but the present invention is not limited thereto.

The accelerating device 460 comprises a bias voltage generator 463 for generating the bias voltage $V_{bias}$. For example, the bias voltage generator 463 is composed of a n-MOSFET $T_3$ and a resistor $R_2$, wherein the transistor $T_3$ has a gate coupled to the voltage source 470 for receiving the input voltage $V_{in}$, a source coupled to a low level (for convenience, the low level is the same with the grounded voltage $V_{GND}$ here, but the present invention is not limited thereto in other embodiments), and a drain for providing the bias voltage $V_{bias}$ to the input end B of the stabilizing device 440. The resistor $R_2$ is coupled between a high level (for convenience, the high level is the same with the high voltage $V_H$ here, but the present invention is not limited thereto in other embodiments) and the drain of the transistor $T_3$. Those skilled in the art could dispose a proper resistor $R_2$ to generate the bias voltage $V_{bias}$.

Besides, the accelerating device 460 in the present invention further comprises a compensating device 461 for compensating the bias voltage $V_{bias}$ when the bias voltage $V_{bias}$ does not consist with a standard bias voltage $V_o$. According to the present invention, the standard bias voltage $V_o$ has to be stable and consisting with the original bias voltage $V_{bias}$. In this embodiment, the compensating device 461 is a n-MOSFET $T_1$ which has a gate coupled to the standard bias voltage $V_0$, a drain coupled to a high level (for convenience, the high level is the same with the high voltage $V_H$ here, but the present invention is not limited thereto in other embodiments), and a source coupled to the input end B of the stabilizing device 440 and the drain of the bias voltage generator 463. Those skilled in the art understands that when the difference between the standard bias voltage $V_o$ received by the gate of the transistor $T_1$ and the bias voltage $V_{bias}$ received by the source of the transistor $T_1$ exceeds the threshold voltage $V_T$ of the transistor $T_1$, the high voltage $V_H$ received by the drain of the transistor T1 will charge and stabilize the bias voltage $V_{bias}$ immediately.

Figure 1:
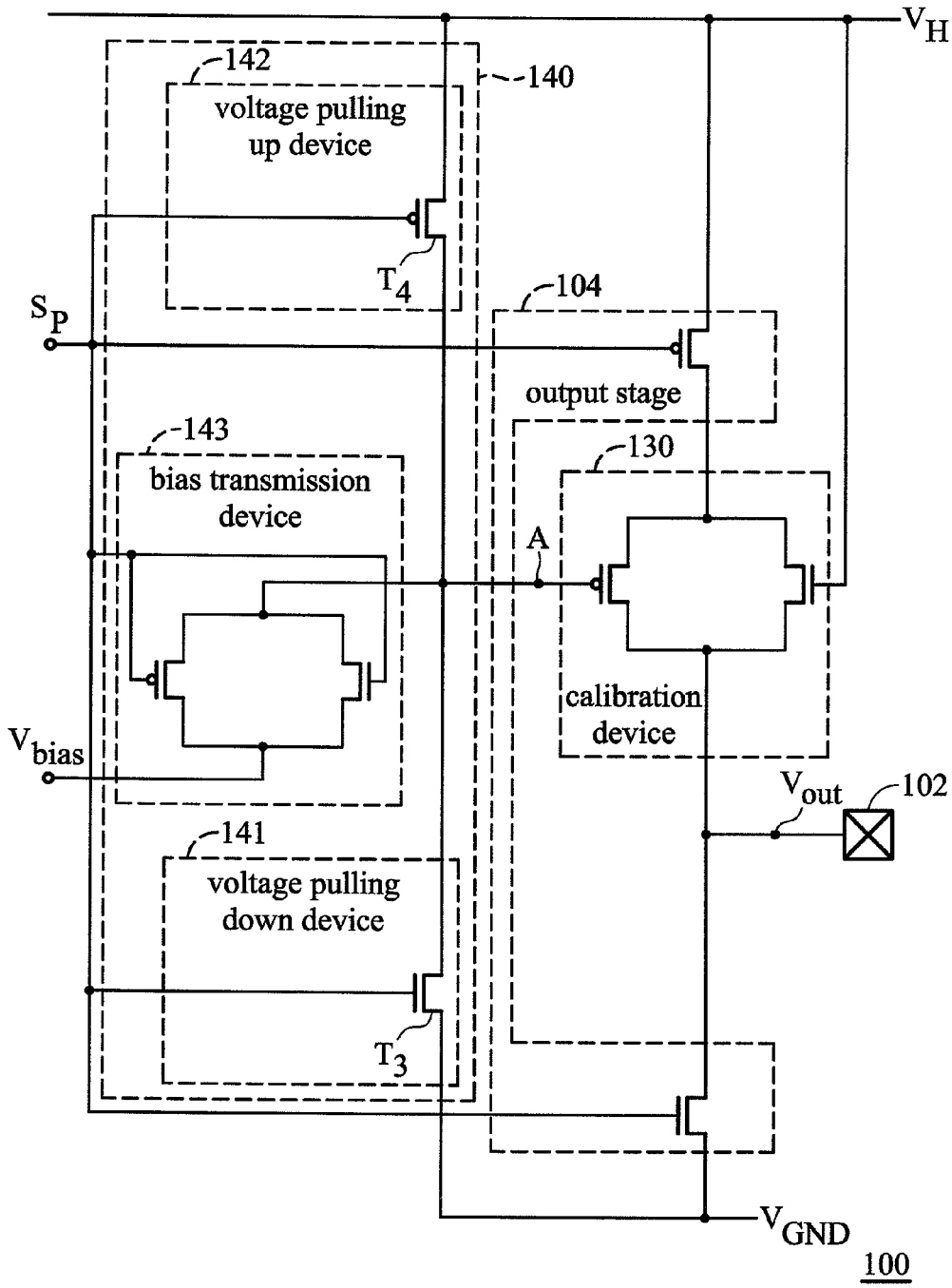
FIG. 1 ( PRIOR ART )
FIG. 1 is a schematic diagram illustrating the driver circuit in the prior art.
Figure 2:
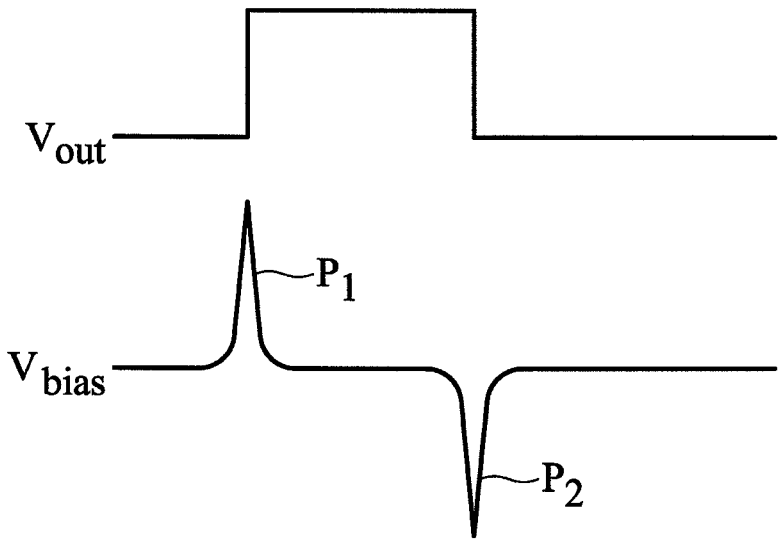
FIG. 2 shows timing diagrams of the output voltage and the bias voltage.
Figure 3A:
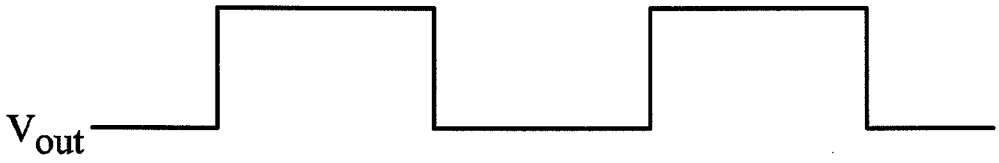
FIG. 3A shows the timing diagram of the output voltage Vout.
Figure 3B:
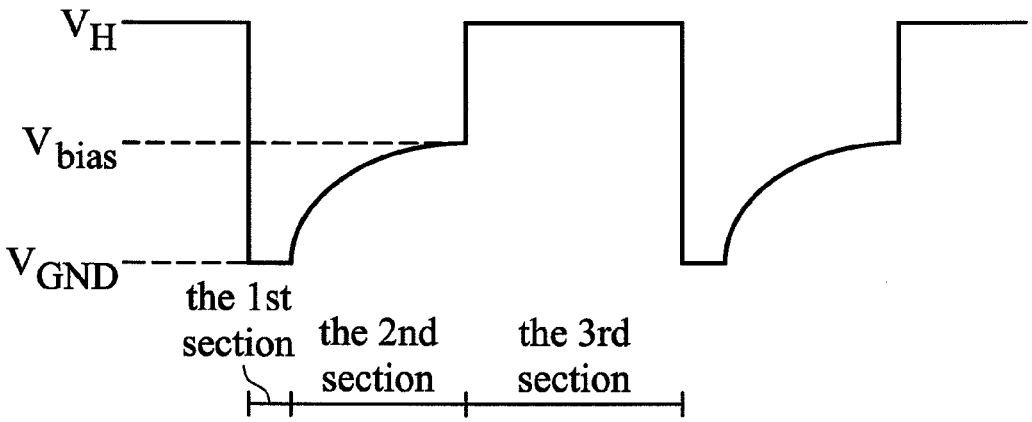
FIG. 3B shows the timing diagram of the voltage provided by the stabilizing device according to the output voltage.
Figure 5:
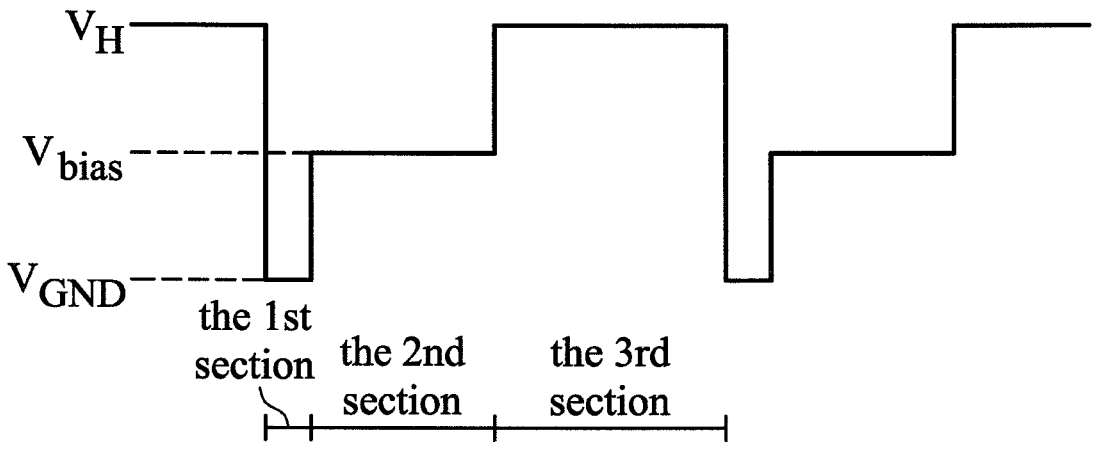
FIG. 5 is a timing diagram of the voltage on the output end of the stabilizing device by using the accelerating device according to the present invention.

In an embodiment, the standard bias voltage $V_o$ could be provided by a standard bias voltage generator 462. The standard bias voltage generator 462 could be composed of an n-MOSFET $T_2$ and a resistor $R_1$. The transistor $T_2$ has a gate coupled to the voltage source 470 for receiving the input voltage $V_{in}$, a source coupled to a low level (for convenience, the low level is the same with the grounded voltage $V_{GND}$ here, but the present invention is not limited thereto in other embodiments), and a drain for providing the standard bias voltage $V_0$ to the gate of the compensating device 461. Note that, according to the present invention, the standard bias voltage generator 462 has to be the same with the bias voltage generator 463, which means that the transistor $T_2$ and the transistor $T_3$ have to match with each other (both have the same aspect ratio), the resistances of the resistor $R_1$ and $R_2$ are the same with each other and coupled to the same high voltage $V_H$ and low voltage $V_{GND}$. Since the standard bias voltage generator 462 and the bias voltage generator 463 are the same with each other, they output the same voltages respectively on the output ends of themselves after receiving the input voltage $V_{in}$ from the voltage source 470. Further, with the operation of the compensating device 461, the voltages difference between the output end of the standard bias voltage generator 462 and the bias voltage generator 463 could be compensated immediately. FIG. 5 is a timing diagram of the voltage on the output end of the stabilizing device 440 by using the accelerating device 460 according to the present invention. Compared with FIG. 3B, section 2 in FIG. 5 is apparently improved.

Figure 6:
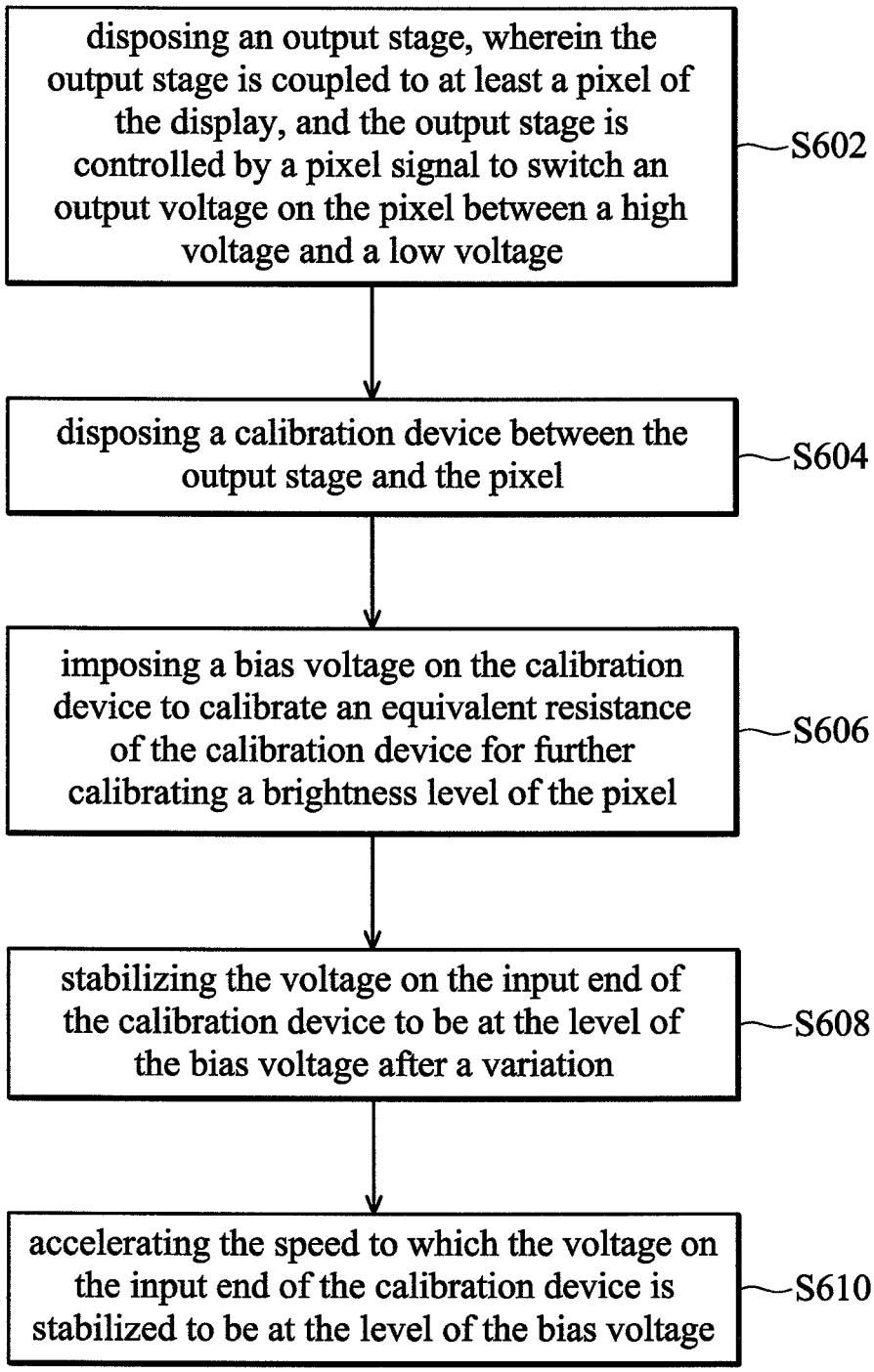
FIG. 6 is a flow chart of method for calibrating the brightness of a display.

In addition, the present invention further provides a method for calibrating the brightness of a display. FIG. 6 is a flow chart of the method. Referring FIGS. 6 and 4, the method for calibrating the brightness of a display comprising: in step S602, disposing an output stage 404, wherein the output stage 404 is coupled to at least a pixel 402 of the display, and the output stage 404 is controlled by a pixel signal $S_P$ to switch an output voltage $V_{out}$ on the pixel 402 between a high voltage $V_H$ and a low voltage $V_{GND}$; in step S604, disposing a calibration device 430 between the output stage 404 and the pixel 402; in step S606, imposing a bias voltage $V_{bias}$ on the calibration device 430 to calibrate a equivalent resistance of the calibration device 430 for further calibrating the brightness of the pixel 402; in step S608, stabilizing the voltage on the input end of the calibration device 430 to be at the level of the bias voltage $V_{bias}$ after a variation; and in step S610, accelerating the speed stabilizing the voltage on the input end of the calibration device 430 to be at the level of the bias voltage $V_{bias}$.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A drive circuit of a display for driving at least a pixel, comprising:

an output stage coupled to the pixel and controlled by a pixel signal to switch an output voltage on the pixel between a high voltage and a low voltage;

a calibration device coupled between the output stage and the pixel, wherein an input end of the calibration device controlled by a bias voltage to adjust the equivalent resistance of the calibration device for calibrating the brightness of the pixel;

a stabilizing device coupled to the input end of the calibration device for stabilizing the voltage on the input end of the calibration device to be at the level of the bias voltage after a variation; and an accelerating device coupled between the stabilizing device and a voltage source for generating the bias voltage and accelerating the speed stabilizing the voltage on the input end of the calibration device to be at the level of the bias voltage, wherein the accelerating device further comprises a compensating device for compensating the bias voltage when the bias voltage does not consist with a standard bias voltage.

2. The drive circuit as claimed in claim 1, wherein the compensating device further comprises:

a first transistor, comprising:

a first gate for receiving the standard bias voltage;

a first drain coupled to a first high level; and a first source coupled to the stabilizing device and the bias voltage.

3. The drive circuit as claimed in claim 1, wherein the standard bias voltage is provided by a standard bias voltage generator, the standard bias voltage generator comprises:

a second transistor, comprising:

a second gate coupled to the voltage source;

a second source coupled to a first low level; and a second drain for providing the standard bias voltage; and a first resistor coupled between a second high level and the second drain.

4. The drive circuit as claimed in claim 3, wherein the accelerating device comprises a bias voltage generator for providing the bias voltage to the stabilizing device.

5. The drive circuit as claimed in claim 4, wherein the bias voltage generator further comprises:

a third transistor, comprising:

a third gate coupled to the voltage source;

a third source coupled to a second low level; and a third drain for providing the bias voltage; and a second resistor coupled between a third high level and the third drain.

6. The drive circuit as claimed in claim 5, wherein the first resistor matches the second resistor, and the second transistor matches the third transistor.

7. The drive circuit as claimed in claim 5, wherein the second high level is the third high level, and the first low level is the second low level.

8. The drive circuit as claimed in claim 5, wherein the first transistor, the second transistor and the third transistor are a p-type-MOSFET.

9. The drive circuit as claimed in claim 1, wherein the stabilizing device comprises a voltage pulling device for pulling down the bias voltage when the output voltage switches from the low voltage to the high voltage.

10. The drive circuit as claimed in claim 1, wherein the stabilizing device further comprises a voltage pulling up device for pulling up the bias voltage when the output voltage switches from the high voltage to the low voltage.

11. The drive circuit as claimed in claim 1, wherein the stabilizing device further comprises a bias transmission device coupled between the calibration device and the accelerating device for transmitting the bias voltage to the input end of the calibration device.

12. The drive circuit as claimed in claim 1, wherein the display is a carbon nanotube display (CNDP).

13. A method for calibrating the brightness of a display, comprising:

disposing an output stage, wherein the output stage is coupled to at least a pixel of the display, and the output stage is controlled by a pixel signal to switch an output voltage on the pixel between a high voltage and a low voltage;

disposing a calibration device between the output stage and the pixel;

imposing a bias voltage on the calibration device to adjust a equivalent resistance of the calibration device for calibrating the brightness of the pixel;

stabilizing the voltage on the input end of the calibration device to be at the level of the bias voltage after a variation; and accelerating the speed stabilizing the voltage on the input end of the calibration device to be at the level of the bias voltage through compensating the bias voltage when the bias voltage does not consist with a standard bias voltage.

* * * * *